US008310161B2

(12) United States Patent
Ito et al.

(10) Patent No.: US 8,310,161 B2
(45) Date of Patent: Nov. 13, 2012

(54) END OF LIFE INDICATOR FOR LAMPS

(75) Inventors: Heinz W. Ito, Topsfield, MA (US); Dan Bodocan, Drummondville (CA); Shaun P. Montana, Medway, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 270 days.

(21) Appl. No.: 12/870,066

(22) Filed: Aug. 27, 2010

(65) Prior Publication Data

US 2012/0049734 A1 Mar. 1, 2012

(51) Int. Cl.
*H01J 1/60* (2006.01)
*H01J 7/42* (2006.01)
*H05B 37/04* (2006.01)

(52) U.S. Cl. ..... 315/129; 315/120; 315/131; 315/132; 315/133

(58) Field of Classification Search ..... None
See application file for complete search history.

(56) References Cited

U.S. PATENT DOCUMENTS

| | | | | |
|---|---|---|---|---|
| 6,400,104 | B1 * | 6/2002 | Ham | 315/312 |
| 8,193,713 | B2 * | 6/2012 | Jung et al. | 315/158 |
| 2005/0195600 | A1 | 9/2005 | Porchia et al. | |
| 2006/0238136 | A1 | 10/2006 | Johnson, III et al. | |
| 2008/0030143 | A1 * | 2/2008 | Goriki et al. | 315/209 R |
| 2010/0060171 | A1 | 3/2010 | Goitiandia et al. | |

FOREIGN PATENT DOCUMENTS

WO 99/53236 A1 10/1999

* cited by examiner

*Primary Examiner* — Anh Tran
(74) *Attorney, Agent, or Firm* — Shaun P. Montana

(57) ABSTRACT

End-of-life indicators for lamps, and methods for indicating the end-of-life for lamps, are provided. A solid state light source end-of-life indicator is located on the exterior of a housing of a lamp, and includes at least one light emitting diode. The solid state light source end-of-life indicator emits light at the end of the life of the lamp. The solid state light source end-of-life indicator may emit light upon receiving an end-of-life signal from an end-of-life detection circuit, which detects when the lamp is at an end of its life.

17 Claims, 6 Drawing Sheets

END OF LIFE INDICATOR FOR LAMPS

TECHNICAL FIELD

The present invention relates to lighting, and more specifically, to end-of-life indicators for lamps.

BACKGROUND

All types of lamps have a rated (i.e., expected) service life (also referred to herein as "end of life"), usually determined by the lamp manufacturer/seller prior to the lamp being sold. All lamps eventually cease to provide light, whether due to an unexpected failure of one or more components, or because the lamp simply reached its end of life at some point in time after first being put into use. In a simple, conventional incandescent lamp, a user or a manufacturer may not care why the lamp is no longing working, whether due to failure or having reached its end of life. However, with more complex energy-efficient lamps, such as compact fluorescent lamps, the user or manufacturer may desire to determine the cause of light no longer being provided, whether due to failure of one or more components, or because the lamp simply reached the end of its life.

SUMMARY

In conventional incandescent lamps, it is easy to determine when the lamp reaches the end of its life—it ceases to generate light. Typically, due to their low cost and expected short service life, the user and/or manufacturer of an incandescent lamp does not care why, unless the problem is endemic across a large number of lamps. In contrast, users and/or manufacturers of compact fluorescent lamps, due to their greater costs and longer expected service lives (compared to incandescent lamps), may desire to know if a lamp is no longer provided light because it has failed before it should have, or if it has simply reached its end of life. Conventional techniques for determining whether the lamp failed early, or reached its end of life, typically involve the lamp being examined in laboratory setting by the manufacturer. This is time-consuming, costly, and dependent on the customer provided the non-functioning lamp to the manufacturer.

Embodiments described herein provide for a simple, inexpensive, easily viewable end-of-life indicator on a lamp. The end-of-life indicator is one or more solid state light sources, such as but not limited to light emitting diodes (LEDs). The end-of-life indicator emits light or otherwise signals that the lamp has reached the expected end of its life. In some embodiments, the end-of-life indicator activates only when the lamp has reached the expected end of its life. This provides both the lamp user and the lamp manufacturer will a clear indication that the lamp is no longer providing light, not due to failure of a component, but because the lamp has simply reached the expected end of its service life. The end-of-life indicator may also serve as a replacement light source when the lamp ceases to provide light. That is, the lamp itself is no longer providing light because it has reached the end of its life, and so the end-of-life indicator provides some light in place of the lamp. Particularly in locations where the lamp is otherwise the only source of light, the end-of-life indicator may serve as a safety feature, so that the location previously being lit by the lamp will have at least some light present.

In an embodiment, there is provided a compact fluorescent lamp. The compact fluorescent lamp includes a light source; a ballast; a base, wherein the base is operatively connectable to a power source; a housing, wherein the housing is coupled to the base and surrounds at least in part the ballast and the light source; and a solid state light source end-of-life indicator, wherein the solid state light source end-of-life indicator includes at least one light emitting diode, is located on an exterior of the housing, and emits light at the end of life of the compact fluorescent lamp.

In a related embodiment, the compact fluorescent lamp further includes an end-of-life detection circuit, wherein the end-of-life detection circuit may detect when the compact fluorescent lamp is at an end of its life, and may provide an end-of-life signal to the solid state light source end-of-life indicator; and wherein the solid state light source end-of-life indicator may include a solid state light source end-of-life indicator, wherein the solid state light source end-of-life indicator may include at least one light emitting diode, may be located on the exterior of the housing, and may emit light upon receiving the end-of-life signal from the end-of-life detection circuit.

In a further related embodiment, upon receiving the end-of-life signal from the end-of-life detection circuit, the solid state light source end-of-life indicator may change color periodically. In another further related embodiment, upon receiving the end-of-life signal from the end-of-life detection circuit, the solid state light source end-of-life indicator may turn on, emitting light, and may turn off, ceasing to emit light, periodically. In still another further related embodiment, upon receiving the end-of-life signal from the end-of-life detection circuit, the solid state light source end-of-life indicator may emit light that changes in luminance periodically. In a further related embodiment, the change in luminance may be an increasing of luminance from a minimum level to a maximum level followed by a decreasing of luminance from the maximum level back to the minimum level, wherein the change in luminance may be periodic.

In a further related embodiment, the end-of-life detection circuit may provide a near end-of-life signal to the solid state light source end-of-life indicator and may provide an end-of-life signal to the solid state light source end-of-life indicator, and the solid state light source end-of-life indicator may emit light at or near the end of life of the compact fluorescent lamp. In a further related embodiment, upon receipt of the near end-of-life signal, the solid state light source end-of-life indicator may emit light of a first color, and upon receipt of the end-of-life signal, the solid state light source end of light indicator may emit light in a second color. In a further related embodiment, upon receipt of the near end-of-life signal, the solid state light source end-of-life indicator may emit light that changes periodically from a first color to a second color, and upon receipt of the end-of-life signal, the solid state light source end of light indicator may emit light in only the second color. In another further related embodiment, upon receipt of the near end-of-life signal, the solid state light source end-of-life indicator may turn on and off periodically, and upon receipt of the end-of-life signal, the solid state light source end-of-life indicator may turn on continuously.

In a further related embodiment, the solid state light source end-of-life indicator may include at least a first light emitting diode and a second light emitting diode, wherein the first light emitting diode may emit light of a first color and wherein the second light emitting diode may emit light of a second color.

In yet another further related embodiment, the compact fluorescent lamp may further include a lamp shutdown circuit, wherein the lamp shutdown circuit shuts down the light source after receiving the end-of-life signal. In still another further related embodiment, the end-of-life detection circuit may be operably connected to the ballast. In another further related embodiment, the end-of-life detection circuit, the solid state light source end-of-life indicator, and the lamp shutdown circuit may be operably connected to the ballast.

In still yet another further related embodiment, the end-of-life detection circuit may include an end-of-life detection circuit, wherein the end-of-life detection circuit may detect when light emitted by the light source falls below a threshold level and, in response, may provide an end-of-life signal to the solid state light source end-of-life indicator. In a further related embodiment, the end-of-life detection circuit, in response to detecting when light emitted by the light source falls below a threshold level, may provide a shutdown signal; and the compact fluorescent lamp may further include a lamp shutdown circuit, wherein the lamp shutdown circuit may shut down the light source upon receiving the provided shutdown signal from the end-of-life detection circuit.

In yet still another further related embodiment, the end-of-life detection circuit may provide a near end-of-life signal to the solid state light source end-of-life indicator when light emitted by the light source falls below a first threshold level, and may provide an end-of-life signal to the solid state light source end-of-life indicator when light emitted by the light source falls below a second threshold level.

In another related embodiment, the compact fluorescent lamp may further include a solid state light source early end-of-life indicator, wherein the solid state light source early end-of-life indicator may include at least one light emitting diode, may be located on the exterior of the housing, and may emit light only when the compact fluorescent lamp experiences an early end of life. In a further related embodiment, the compact fluorescent lamp may further include an early end-of-life detection circuit, wherein the early end-of-life detection circuit may detect when the compact fluorescent lamp is at an early end of its life, and may provide an early end-of-life signal to the solid state light source early end-of-life indicator; and wherein the solid state light source early end-of-life indicator may include a solid state light source early end-of-life indicator, wherein the solid state light source early end-of-life indicator may include at least one light emitting diode, may be located on the exterior of the housing, and may emit light only upon receiving the early end-of-life signal from the end-of-life detection circuit.

In an embodiment, there is provided a method of indicating end-of-lamp life in a compact fluorescent lamp. The method includes receiving power at the compact fluorescent lamp; emitting light from a light source of the compact fluorescent lamp; detecting, in an end-of-life detection circuit, when the compact fluorescent lamp is at an end of its life; in response, providing an end-of-life signal to a solid state light source end-of-life indicator; and in response, activating the solid state light source end-of-life indicator to emit light, indicating that the compact fluorescent lamp has reached the end of its life.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
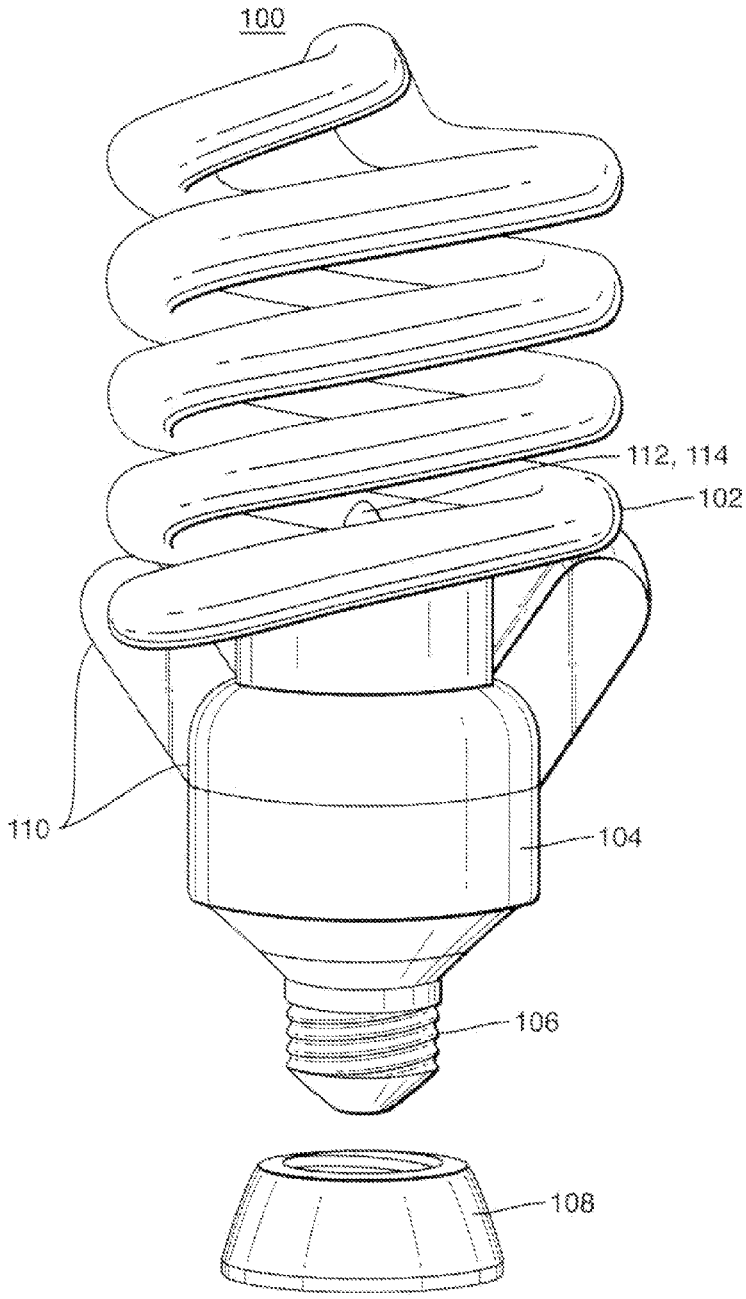
FIG. 1 shows a lamp with a solid state light source end-of-life indicator, according to embodiments disclosed herein.
Figure 2:
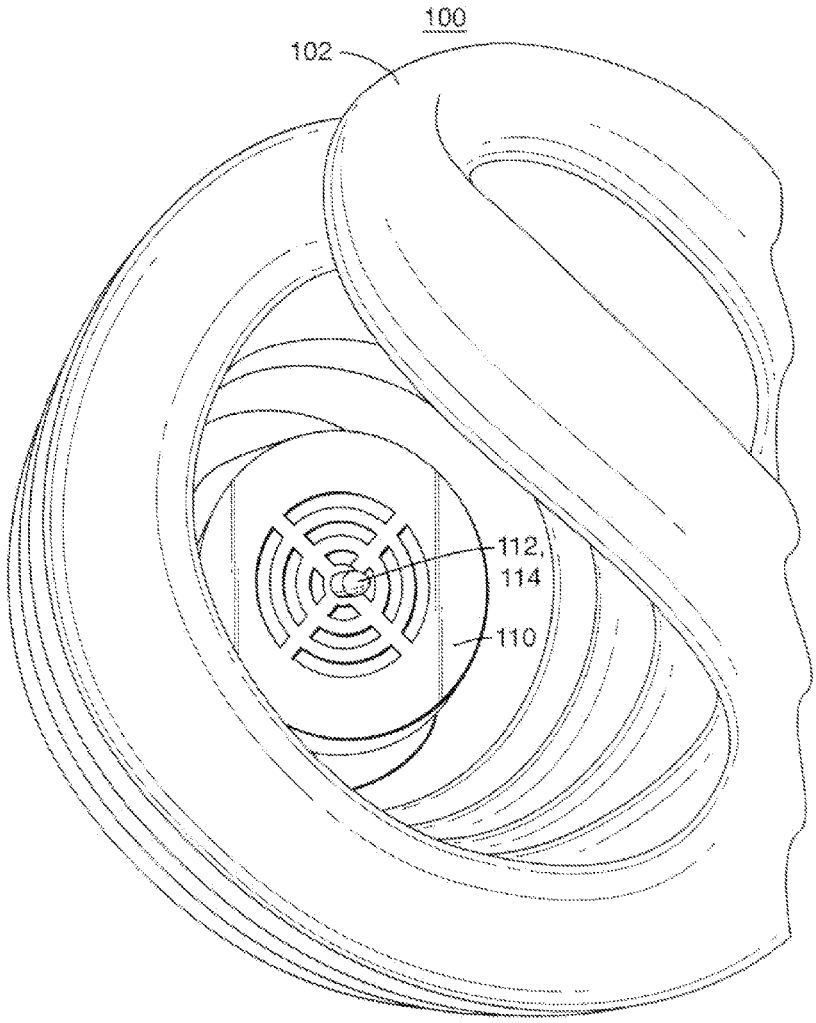
FIG. 2 shows a top view of the lamp shown in FIG. 1 with the solid state light source end-of-life indicator illuminated.

FIG. 1 shows a lamp 100 with a solid state light source end-of-life indicator 112, according to embodiments described herein. Though the lamp 100 shown in FIG. 1 is a compact fluorescent lamp, and throughout this specification, embodiments are described with respect to compact fluorescent lamps, the invention is not limited to compact fluorescent lamps but rather may be used with any type of lamp and/or system (i.e., fixture or other device incorporating a light/lamp/light source/load) that is capable of including an end-of-life indicator. The lamp 100 includes a light source 102, which in FIG. 1 is the compact fluorescent portion (i.e., gas-filled phosphor-coated twist tube) of the lamp 100. The compact fluorescent lamp 100 shown in FIG. 1 also includes a ballast 104, which is covered, at least in part, by a housing 110. The housing 110 is typically made of plastic, though may be made of other materials (e.g., metal), or combinations thereof. The ballast 104 may be an electronic ballast, though in other embodiments, particularly for other lamps, other types of circuitry may be used. The housing 110 also surrounds, at least in part, the light source 102, as can be seen in FIG. 1 where the tube of the light source 102 exits from an opening in the housing 110. The lamp 100 also includes a base 106, which is operatively connectable to a power source, such as a lamp socket 108. On the exterior of the lamp 100, the housing 110 is coupled to the base 106, and on the interior of the lamp 100, the ballast 104 and light source 102 are coupled to the base 106 as well, to receive power therefrom. The solid state light source end-of-life indicator 112 as shown in FIG. 1 is a single light emitting diode 114, though in other embodiments may be an organic light emitting diode or other type of solid state light source. As described in greater detail below, in some embodiments, the solid state light source end-of-life indicator 112 may include more than one light emitting diode and/or solid state light source. The solid state light source end-of-life indicator 112 is located on an exterior of the housing 110, as is seen more clearly in FIG. 2, where the light emitting diode 114 is on a top portion of the housing 110, surrounded by the tube of the light source 102. The solid state light source end-of-life indicator 112 is not limited to being located on the top portion of the housing 110 as shown in FIG. 2, but rather may be located on any exterior portion of the housing 110, including but not limited to a side portion of the housing 110. In some embodiments, the solid state light source end-of-life indicator 112 may be located on any exterior portion of the lamp 100, not just the housing 110. In some embodiments, only a portion of the solid state light source end-of-life indicator 112 may be visible when viewing the housing 110, that is, for example, the solid state light source end-of-life indicator 112 may be partially and/or fully recessed within the housing 110 and/or some other portion of the lamp 100. When the lamp 100 is at the end of its life, the solid state light source end-of-life indicator 112 is activated (i.e., turns on), and emits light, so long as the lamp 100 is still receiving power and/or the solid state light source end-of-life indicator 112 is able to receive power.

The solid state light source end-of-life indicator 112 may be made from any solid state light source, including but not limited to one or more light emitting diodes 114 shown throughout FIGS. 1-4 and 6. The solid state light source end-of-life indicator 112 may behave in a variety of ways to indicate that the end of life of the lamp 100 has occurred, or is nearing occurrence. As described above, in some embodiments, the solid state light source end-of-life indicator 112 simply turns on (i.e., emits light) to indicate end-of-life for the lamp 100. In some embodiments, the solid state light source end-of-life indicator 112 may change color periodically (that is, over a period of time). For example, the solid state light source end-of-life indicator 112 may first emit green light, and then red light, and then blue light. Any possible combination of colors, in any possible order and/or combination, may be used. In some embodiments, the solid state light source end-of-life indicator 112 turns on, and then turns off, periodically, such that the solid state light source end-of-life indicator 112 seems to be blinking (i.e., emits light for a portion of time, then does not emit light for a portion of time, then emits light again for a portion of time, then does not emit light for a portion of time, etc.) to indicate the end-of-life of the lamp 100. This blinking effect may be achieved in any number of ways, including but not limited to use of a switch to provide power to the solid state light source end-of-life indicator 112, and/or using pulse width modulation or other type of switching signal with the solid state light source end-of-life indicator 112. In some embodiments, the solid state light source end-of-life indicator 112 may emit light that changes in luminance periodically. That is, the solid state light source end-of-life indicator 112 may become, to a human eye and/or other instrument/device capable of measuring light, brighter and/or dimmer over time. In some embodiments, the change of luminance may follow a particular pattern, such as but not limited to an increasing of luminance from a minimum level to a maximum level, followed by a decreasing of luminance from the maximum level back to the minimum level, and repeated over a period of time. Any possible combination of patterns of changes in luminance, including random patterns, is contemplated within the scope of the invention.

In some embodiments, the solid state light source end-of-life indicator must be told when to activate, that is, when the lamp has reached its end-of-life. This may be done through use of an end-of-life detection circuit, such as the end-of-life detection circuit 308 shown in FIG. 3. The end-of-life detection circuit 308 detects when the lamp 300 is at an end of its life. The end-of-life detection circuit 308 also provides an end-of-life signal to the solid state light source end-of-life indicator 310. In such embodiments, the solid state light source end-of-life indicator 310 includes at least one light emitting diode 312, which activates (i.e., turns on) upon receiving the end-of-life signal from the end-of-life detection circuit 308. The solid state light source end-of-life indicator 310/light emitting diode 312 may behave in any of the ways described above with regards to FIGS. 1 and 2, and may share any of the characteristics of the similar elements shown in FIGS. 1 and 2. In some embodiments, the behavior of the solid state light source end-of-life indicator 310 is only triggered after the solid state light source end-of-life indicator 310 receives the end-of-life signal from the end-of-life detection circuit 308. That is, for example, the solid state light source end-of-life indicator 310 may change color periodically, or may turn on and off periodically, upon receiving the end-of-life signal from the end-of-life detection circuit 308.

Figure 3:
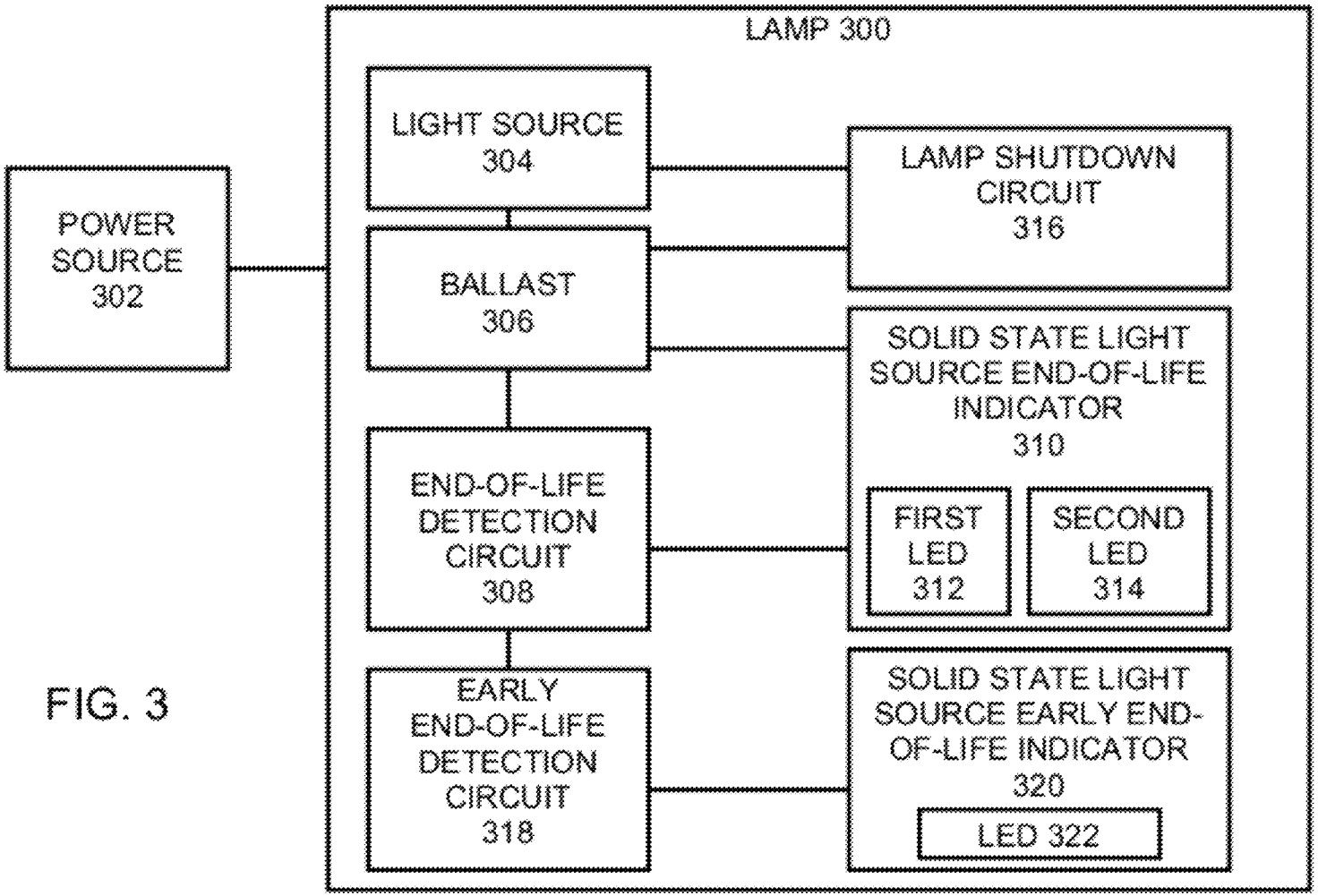
FIG. 3 shows a block diagram of a lamp and a power source therefore, according to embodiments described herein.
Figure 4:
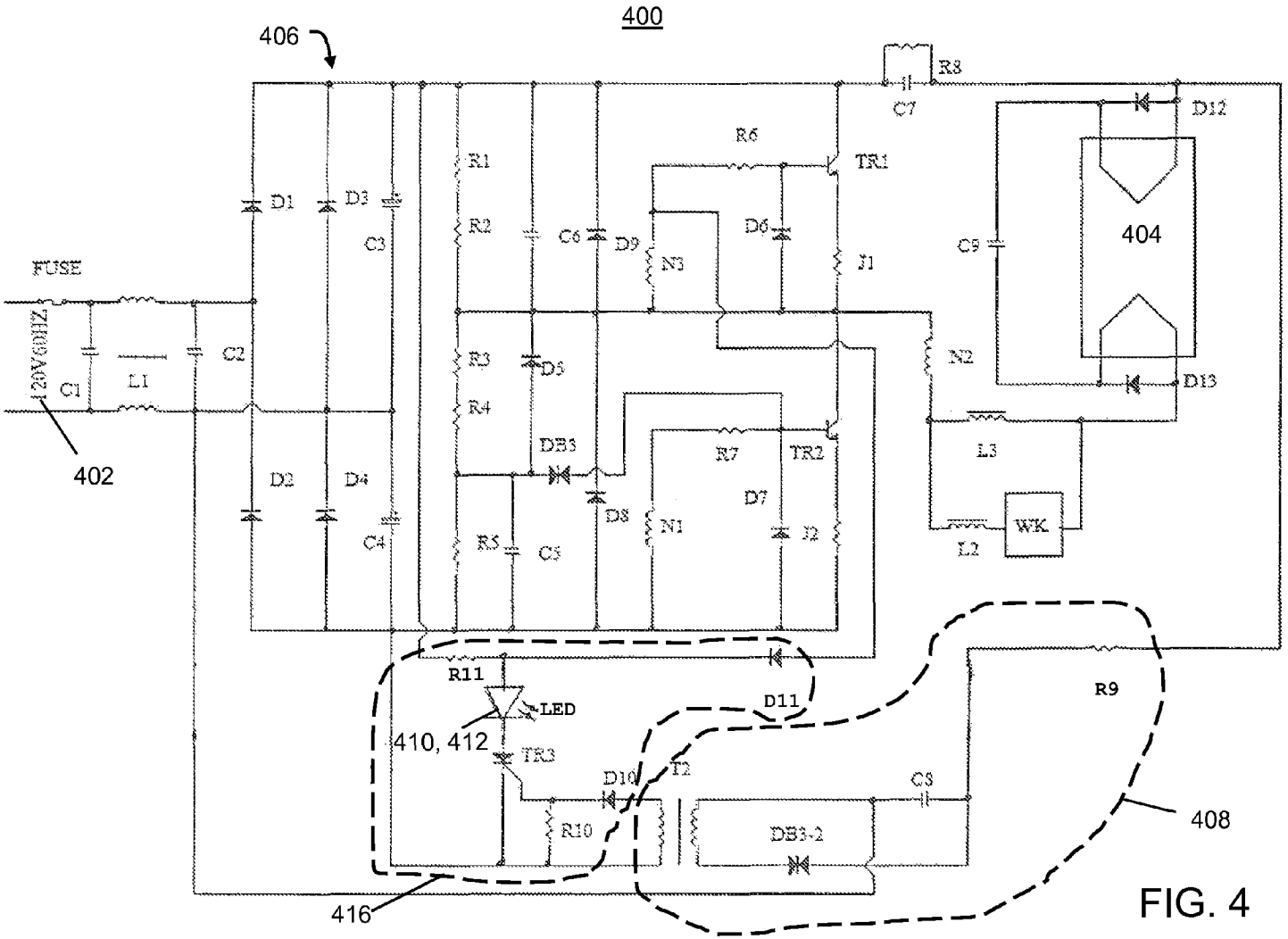
FIG. 4 illustrates a circuit of a compact fluorescent lamp according to embodiments described herein.

FIG. 4, as part of a lamp circuit 400, shows an example end-of-life detection circuit 408, which may be used as the end-of-life detection circuit 308 in the block diagram of FIG. 3. The end-of-life detection circuit 408 includes a resistor R9, a capacitor C8, a transformer T2, and a diac DB3-2. The resistor R9 is connected in series with the capacitor C8. A winding of the transformer T2 is connected in series with the diac DB3-2, and this combination is connected in parallel with the capacitor C8. The entire end-of-life detection circuit 408 is connected to a ballast 406 of a lamp, such as but not limited to the lamp 100 shown in FIGS. 1-2. In the lamp circuit 400, as the lamp 404 begins to approach the end of its life, a voltage difference appears across diodes D12 and D13. This causes the capacitor C8 to begin to charge, and the voltage on the diac DB3-2 begins to approach its breakdown voltage level. As the lamp 404 ages further, and the voltage difference on the lamp 404 increases, the capacitor C8 charges further and, at some point, the capacitor C8 is fully charged and the breakdown voltage of the diac DB3-2 is exceeded. This causes the transformer T2 to receive voltage, and a solid state light source end-of-life indicator 410 turns on. In other words, when the end-of-life detection circuit 408 detects the end of life of the lamp, the end-of-life detection circuit 408 signals the solid state light source end-of-life indicator 410 (in FIG. 4, the LED 412) to activate (i.e., turn on/emit light). Of course, the end-of-life detection circuit 408 shown in FIG. 4 is just one example of the components and arrangement thereof needed to create an end-of-life detection circuit, and in other embodiments, other components and/or arrangements may be used. For example, the transformer T2 may include an optocoupler in some embodiments.

The end-of-life detection circuit 308, in some embodiments, may also provide a near end-of-life signal to the solid state light source end-of-life indicator 310. The near end-of-life signal may indicate to the solid state light source end-of-life indicator (and thus ultimately to a user of the lamp 300) that the lamp 300 is nearing the end of its life, but has not yet reached the end of its life. Thus, near end-of-life may mean that the lamp has reached 50% of its expected service life, or 75%, or 90%, or 95%, or any value in between any of these and 100% (i.e., end of life). In some embodiments, near end-of-life may be arranged or otherwise set to indicate that some amount of expected service of the lamp less than 50% has been reached. Upon receiving the near end-of-life signal, and then later receiving the end-of-life signal, from the end-of-life detection circuit 318, the solid state light source end-of-life indicator 310 may behave in a variety of different ways, such as but not limited to any of the behaviors of the solid state light source end-of-life indicator 112 described above with regards to FIGS. 1-2. Thus, in some embodiments, upon receipt of the near end-of-life signal, the solid state light source end-of-life indicator 310 may emit light of a first color. Later, upon receipt of the end-of-life signal, the solid state light source end of light indicator 310 may emit light in a second color, where the second color is different and/or otherwise distinct from the first color. In some embodiments, upon receipt of the near end-of-life signal, the solid state light source end-of-life indicator 310 may emit light that changes periodically from a first color to a second color, and then upon later receipt of the end-of-life signal, the solid state light source end of light indicator 310 may emit light in only the second color. In some embodiments, upon receipt of the near end-of-life signal, the solid state light source end-of-life indicator 310 may turn on and off periodically, and then upon later receipt of the end-of-life signal, the solid state light source end-of-life indicator 310 may turn on continuously. Alternatively, or additionally, in some embodiments, upon receipt of the near end-of-life signal, the solid state light source end-of-life indicator 310 may turn on continuously, and then later upon receipt of the end-of-life signal, the solid state light source end-of-life indicator may turn on and off periodically. Any combinations of any of these behaviors by the solid state light source end-of-life indicator 310 may be possible within the scope of the invention.

Figure 6:
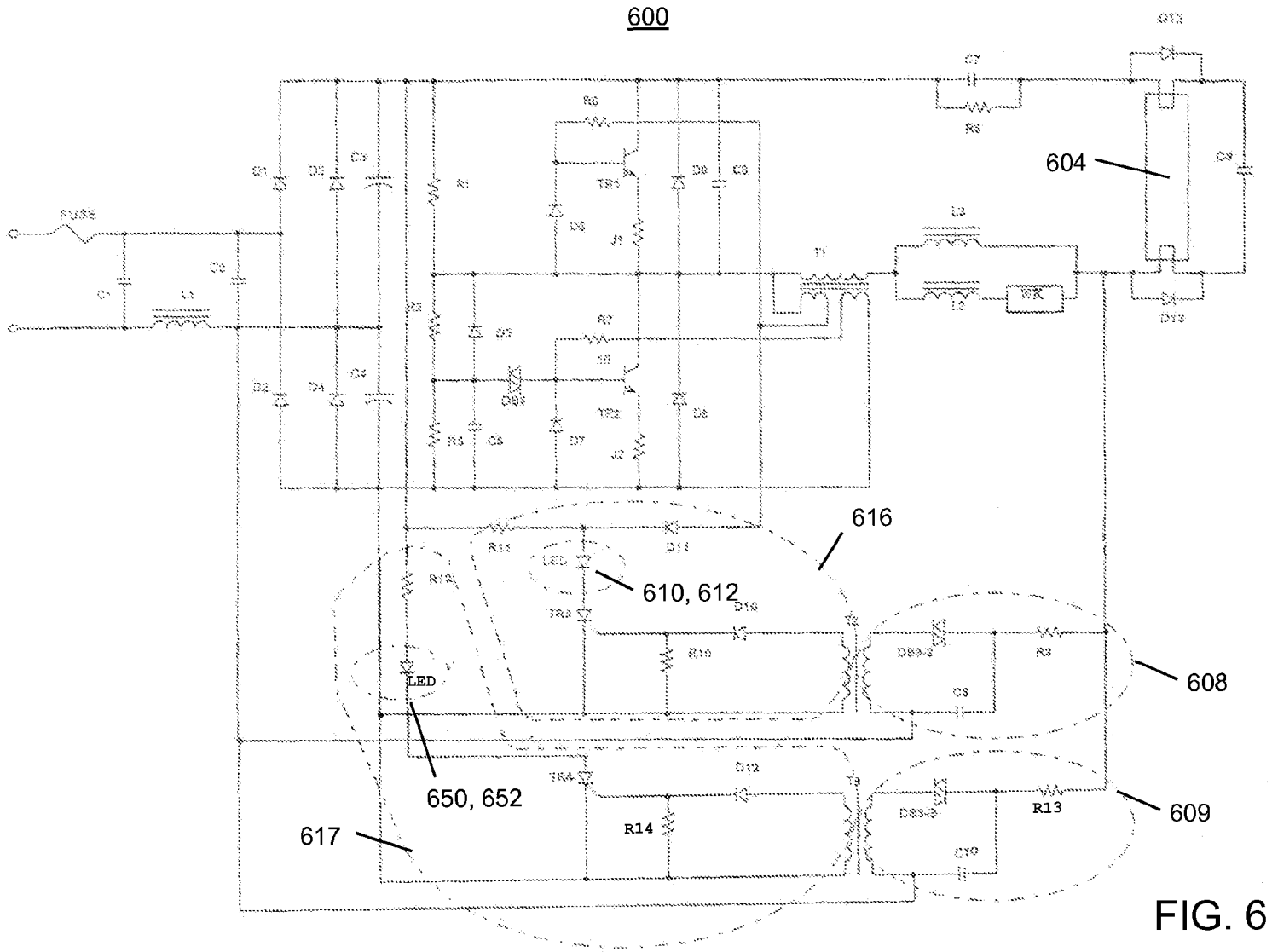
FIG. 6 illustrates a circuit of a compact fluorescent lamp according to embodiments described herein.

In some embodiments, the solid state light source end-of-life indicator 310 may include at least a first light emitting diode 312 and a second light emitting diode 314. The first light emitting diode 312 may emit light of a first color and the second light emitting diode 314 may emit light of a second color. In some embodiments, the first color and second color are different, or otherwise distinct. In some embodiments, the first color and the second color are the same. The first light emitting diode 312 and the second light emitting diode 314 may split the duties of the solid state light source end-of-life indicator 310. That is, in some embodiments, the first light emitting diode 312 may function as the indicator for near end-of-lamp life, while the second light emitting diode 314 may function as the indicator of end-of-lamp life. Of course, either light emitting diode 312, 314 may serve either function. The behavior of the first and second light emitting diodes 312, 314 may be according to any of the behaviors of a solid state light source end-of-life indicator described herein, including for indicating near end-of-life. The number of solid state light sources that may be used within the solid state light source end-of-life indicator is not limited to one or two, but rather, may be any number of solid state light sources. Thus, in some embodiments, three light emitting diodes, or four, or five, may be used to indicate end-of-life, and variants thereof (i.e., near end-of-life). In some embodiments, various patterns of behavior (i.e., color change, intensity change, blinking, pulsing, etc.), including random arrangements and/or combinations thereof, of the solid state light sources may be used to indicate end-of-life for a lamp, as well as near end-of-life. The use of multiple solid state light sources in the solid state light source end-of-life indicator may also serve to create more light to serve as a safety feature of the lamp for when the light source of the lamp fails. Further, in some embodiments, such as a lamp circuit 600 shown in FIG. 6, the use of more than one solid state light source end-of-life indicator 610, i.e. a second solid state light source end-of-life indicator 650, may require use of more than one end-of-life detection circuit 608, i.e. a second end-of-life detection circuit 609. As shown in FIG. 6, the second end-of-life detection circuit may be the same, component and configuration-wise, as the end-of-life detection circuit 608, but in other embodiments, there may be differences between the circuits. Of course, as described above, there may be differences between the solid state light source end-of-life indicator 610 (i.e., an LED 612) and the second solid state light source end-of-life indicator 650 (i.e., an LED 652).

The lamp 300 shown in FIG. 3 also shows a lamp shutdown circuit 316. The lamp shutdown circuit 316 shuts down the light source 304 after receiving the end-of-life signal from the end-of-life detection circuit 308. Though the end-of-life detection circuit 308 is not shown as being directly connected to the lamp shutdown circuit 316 in FIG. 3, such a connection may occur through the ballast 306, to which both components are shown as connected. Indeed, in some embodiments, the end-of-life detection circuit 308 may be considered as part of the ballast 306. Further, in some embodiments, the end-of-life detection circuit 308, the solid state light source end-of-life indicator 310, and the lamp shutdown circuit 316 are all considered as part of the ballast 306, or otherwise operably connected thereto. The lamp circuit 400 of FIG. 4 shows the end-of-life detection circuit 408, a lamp shutdown circuit 416, and the solid state light source end-of-life indicator 410 (i.e., the LED 412) all as being operatively connected to the ballast 406, and thus considered parts of the ballast 406. The lamp shutdown circuit 416 includes a diode D10, a resistor R10, and a thyristor TR3. The diode D10 and the resistor R10 are connected in series, and the combination is connected in parallel across a winding of the transformer T2 of the end-of-life detection circuit 408. The resistor R10 is also itself connected in parallel across a gate and a cathode of the thyristor TR3. An anode of the thyristor TR3 is connected to a cathode of the LED 412. When the transformer T2 receives sufficient voltage via the capacitor C8 and the diac DB3-2 (as described above with regards to the end-of-life detection circuit 408), in addition to activating the LED 412, this causes the thyristor TR3 to activate and the lamp 404 shuts downs. Thus, when the lamp shutdown circuit 416 is told by the end-of-life detection circuit 408 that the lamp has reached its end of life, the lamp shutdown circuit 416 then shuts down the lamp. Power is, of course, still supplied to the solid state light source end-of-life indicator 410 (in FIG. 4, the LED 412) so that it activates (i.e., turns on/emit light) and remains on as long as it is able to receive power. Of course, the lamp shutdown circuit 416 shown in FIG. 4 is just one example of the components and arrangement thereof needed to create a lamp shutdown circuit, and in other embodiments, other components and/or arrangements may be used. Further, as shown in FIG. 6 with the end-of-life detection circuit 608 and the second end-of-life detection circuit 609, there may be more than one lamp shutdown circuit 616 present in a lamp circuit, such as the lamp circuit 600 which includes a second lamp shutdown circuit 617. Of course, the lamp shutdown circuit 616 and the second lamp shutdown circuit 617 may be the same in terms of components and/or configuration, as shown in FIG. 6, or may differ.

In some embodiments, the end-of-life detection circuit 308 may detect that the lamp has reached the end of its life by detecting when light emitting by the light source 304 falls below a certain level. This may be a threshold level set to be a certain value, or may, in some embodiments, vary over time with the life of the lamp 300 and/or depending on whether or not the lamp 300 is capable of being dimmed. When the light emitted by the light source falls below the level, in response, the end-of-life detection circuit 308 provides an end-of-life signal to the solid state light source end-of-life indicator 310. In some embodiments, the end-of-life detection circuit 308 may simultaneously provide a shutdown signal to the lamp shutdown circuit 316, which then shuts down the light source 304 upon receiving the provided shutdown signal from the end-of-life detection circuit 308. Further, in some embodiments, various light levels may be set for use by the end-of-life detection circuit 308. Thus, for example, when light emitted by the light source 304 falls below a first threshold level, the end-of-life detection circuit 308 may provide the near end-of-life signal to the solid state light source end-of-life indicator 310. Then, when light emitted by the light source 304 falls below a second threshold level, the end-of-life detection circuit 308 may provide the end-of-life signal to the solid state light source end-of-life indicator 312. Of course, further combinations of levels may be used if there are more than two states being indicated by the same solid state light source end-of-life indicator 310, or if there are more than one solid state light sources (e.g., LEDs) within the solid state light source end-of-life indicator 310.

Some embodiments may include a solid state light source early end-of-life indicator 320, and a corresponding early end-of-life detection circuit 318, both of which are shown in FIG. 3. The solid state light source early end-of-life indicator 320 may include at least one light emitting diode 322. Similar to the solid state light source end-of-life indicator 310, it may be located on the exterior of the housing of the lamp 300, or on any exterior portion of the lamp 300, and emits light (i.e., is activated) only when the lamp 300 experiences an early end of life. As used herein, early end of life means an end-of-life less than the expected end-of-life of the lamp. The solid state light source early end-of-life indicator 320 may have any characteristic of, and/or may behave in the same way as, the solid state light source end-of-life indicator 310 and/or any equivalent thereof as described throughout. Similarly, the early end-of-life detection circuit 318, which detects when the lamp 300 is at an early end of its life and then provides an early end-of-life signal to the solid state light source early end-of-life indicator 320, may have any characteristic of, and/or may behave in the same way as, the end-of-life detection circuit 308 and/or any equivalent thereof as described throughout.

Figure 5:
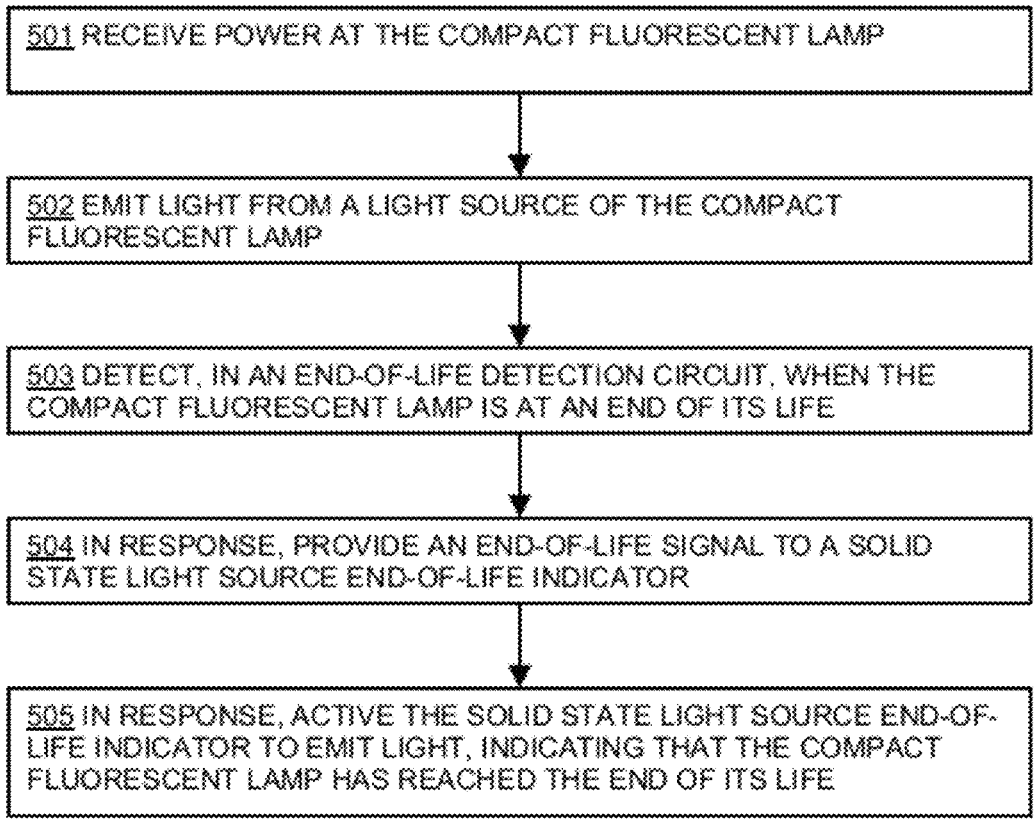
FIG. 5 illustrates a flowchart of an embodiment of a method to indicate, using a solid state light source end-of-life indicator, that a lamp has reached its end-of-life.

A flowchart of a method of providing an end-of-life indication according to embodiments described herein is illustrated in FIG. 5. The rectangular elements are herein denoted "processing blocks" and represent instructions or groups of instructions, or steps, whether performed in software and/or by functionally equivalent circuits, or otherwise performed with only circuit components. In any software-related embodiments, the flowcharts do not depict the syntax of any particular programming language. Rather, the flowcharts illustrate the functional information one of ordinary skill in the art requires to fabricate circuits or to generate software to perform the method according to embodiments described herein. In software-related embodiments, it should be noted that many routine program elements, such as initialization of loops and variables and the use of temporary variables, are not shown. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order. More specifically, FIG. 5 illustrates a flowchart of indicating end-of-lamp life in a compact fluorescent lamp, according to embodiments described herein.

In FIG. 5, the compact fluorescent lamp receives power, step 501. Of course, the compact fluorescent lamp may receive power in any known way, such as but not limited through a base of the lamp being inserted or otherwise operably connected to a socket that provides power for a lamp. Intermediate actions by one or more users of the lamp may also be required, such as turning a switch that send power to the socket to its "ON" (i.e., send power) position, or engaging a control device that otherwise sends power to the socket. Upon the lamp receiving power, a light source of the compact fluorescent lamp then emits light, step 502. Of course, in some embodiments, where the lamp is very close to the end of its life already, or due to the failure of one or more components in the lamp immediately or otherwise soon after the lamp receives power, the light source may emit light for only a tiny period of time and/or may emit only a tiny amount of light, perhaps not easily detectable, or even undetectable, by the human eye. Further, in some embodiments, the light source of the lamp may not emit any light at all, due to the lamp having reached its end-of-life prior to receiving power.

An end-of-life detection circuit detects, step 503, when the compact fluorescent lamp is at an end of its life. The end-of-life detection circuit performs this detection in any of the ways described above, or in any other way known in the art. In response to the detection, an end-of-life signal is provided to a solid state light source end-of-life indicator, step 504. The solid state light source end-of-life indicator may have any of the properties and/or characteristics and/or behaviors described herein. Finally, in response to the end-of-life signal being provided, the solid state light source end-of-life indicator is activated to emit light, step 505, indicating that the compact fluorescent lamp has reached the end of its life. In embodiments where the light source of the lamp does not emit any light, due to the lamp having reached its end-of-life, the solid state light source end-of-life indicator will emit light so long as the lamp is receiving power and so long as the indicator itself, nor any of the components it relies on, have not failed.

It should be noted that, while embodiments herein have been described with regards to particular hardware components and/or configurations, certain elements and/or features may alternatively be executed via software instructions performed on a microprocessor, microcontroller, or the like, located within a lamp, without departing from the scope of the invention. For example, a microcontroller with a clocking/timing element and memory may be set, or otherwise programmed, with the expected time of the life of the lamp, and may then track the actual amount of time that the lamp is in service (i.e., on/emitting light). Comparisons between these values may then be used, for example, to determine whether the lamp has met an early end-of-life, or is at a near end-of-life situation, or has reached its end-of-life. Additionally, or alternatively, a lamp that exceeds its expected service life may also be identified, and in some such embodiments, an indicator may be activated in such circumstances to inform the user and/or others of this situation. Such an indicator may have the characteristics of, and/or may behave the same as or similar to, any of the indicators described herein. Further, particularly in embodiments that include a microprocessor or the like, non-visual end-of-life indicators may alternatively or additionally be used, such as but not limited to auditory indicators that make a sound or sounds, or alternate between different sounds, or make a first sound to indicate a first event (e.g., near end-of-life) and a second sound to indicate a second event (end-of-life). Thus, any auditory indicators used may behave in any of the ways described herein with respect to visual indicators.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer (s), workstation(s) (e.g., Sun, HP), personal digital assistant (s) (PDA(s)), handheld device(s) such as cellular telephone(s) or smart cellphone(s), laptop(s), handheld computer(s), or another device(s) capable of being integrated with a processor (s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A compact fluorescent lam comprising:

a light source:

a ballast;

a base, wherein the base is operatively connectable to a power source;

a housing, wherein the housing is coupled to the base and surrounds at least in part the ballast and the light source;

a solid state light source end-of-life indicator, wherein the solid state light source end-of-life indicator comprises at least one light emitting diode, is located on an exterior of the housing, and emits light at the end of life of the compact fluorescent lamp; and an end-of-life detection circuit, wherein the end-of-life detection circuit detects when the compact fluorescent lamp is at an end of its life, and provides an end-of-life signal to the solid state light source end-of-life indicator:

wherein the solid state light source end-of-life indicator comprises:

a solid state light source end-of-life indicator, wherein the solid state light source end-of-life indicator comprises at least one light emitting diode, is located on the exterior of the housing, and emits, light upon receiving the end-of-life signal from the end-of-life detection circuit; and wherein the end-of-life detection circuit provides a near end-of-life signal to the solid state light source end-of-life indicator and provides an end-of-life signal to the solid state light source end-of-life indicator, and wherein the solid state light source end-of-life indicator emits light at or near the end of life of the compact fluorescent lamp.

2. The compact fluorescent lamp according to claim 1, wherein upon receiving the end-of-life signal from the end-of-life detection circuit, the solid state light source end-of-life indicator changes color periodically.

3. The compact fluorescent lamp according to claim 1, wherein upon receiving the end-of-life signal from the end-of-life detection circuit, the solid state light source end-of-life indicator turns on, emitting light, and turns off, ceasing to emit light, periodically.

4. The compact fluorescent lamp according to claim 1, wherein upon receiving the end-of-life signal from the end-of-life detection circuit, the solid state light source end-of-life indicator emits light that changes in luminance periodically.

5. The compact fluorescent lamp according to claim 4, wherein the change in luminance is an increasing of luminance from a minimum level to a maximum level followed by a decreasing of luminance from the maximum level back to the minimum level, wherein the change in luminance is periodic.

6. The compact fluorescent lamp according to claim 1, wherein upon receipt of the near end-of-life signal, the solid state light source end-of-life indicator emits light of a first color, and upon receipt of the end-of-life signal, the solid state light source end of light indicator emits light in a second color.

7. The compact fluorescent lamp according to claim 6, wherein upon receipt of the near end-of-life signal, the solid state light source end-of-life indicator emits light that changes periodically from a first color to a second color, and upon receipt of the end-of-life signal, the solid state light source end of light indicator emits light in only the second color.

8. The compact fluorescent lamp according to claim 6, wherein upon receipt of the near end-of-life signal, the solid state light source end-of-life indicator turns on and off periodically, and upon receipt of the end-of-life signal, the solid state light source end-of-life indicator turns on continuously.

9. The compact fluorescent lamp according to claim 1, wherein the solid state light source end-of-life indicator includes at least a first light emitting diode and a second light emitting diode, wherein the first light emitting diode emits light of a first color and wherein the second light emitting diode emits light of a second color.

10. The compact fluorescent lamp according to claim 1, further comprising:

a lamp shutdown circuit, wherein the lamp shutdown circuit shuts down the light source after receiving the end-of-life signal.

11. The compact fluorescent lamp according to claim 1, wherein the end-of-life detection circuit is operably connected to the ballast.

12. The compact fluorescent lamp according to claim 10, wherein the end-of-life detection circuit, the solid state light source end-of-life indicator, and the lamp shutdown circuit are operably connected to the ballast.

13. The compact fluorescent lamp according to claim 1, wherein the end-of-life detection circuit comprises:

an end-of-life detection circuit, wherein the end-of-life detection circuit detects when light emitted by the light source falls below a threshold level and, in response, provides an end-of-life signal to the solid state light source end-of-life indicator.

14. The compact fluorescent lamp according to claim 13, wherein the end-of-life detection circuit, in response to detecting when light emitted by the light source falls below a threshold level, provides a shutdown signal;

and wherein the compact fluorescent lamp further comprises:

a lamp shutdown circuit, wherein the lamp shutdown circuit shuts down the light source upon receiving the provided shutdown signal from the end-of-life detection circuit.

15. The compact fluorescent lamp according to claim 1, wherein the end-of-life detection circuit provides a near end-of-life signal to the solid state light source end-of-life indicator when light emitted by the light source falls below a first threshold level, and provides an end-of-life signal to the solid state light source end-of-life indicator when light emitted by the light source falls below a second threshold level.

16. The compact fluorescent lamp according to claim 1 further comprising a solid state light source early end-of-life indicator, wherein the solid state light source early end-of-life indicator comprises at least one light emitting diode, is located on the exterior of the housing, and emits light only when the compact fluorescent lamp experiences an early end of life.

17. The compact fluorescent lamp according to claim 16, further comprising:

an early end-of-life detection circuit, wherein the early end-of-life detection circuit detects when the compact fluorescent lamp is at an early end of its life, and provides an early end-of-life signal to the solid state light source early end-of-life indicator;

and wherein the solid state light source early end-of-life indicator comprises:

a solid state light source early end-of-life indicator, wherein the solid state light source early end-of-life indicator comprises at least one light emitting diode, is located on the exterior of the housing, and emits light only upon receiving the early end-of-life signal from the end-of-life detection circuit.

* * * * *